US006554718B2

(12) United States Patent
Back

(10) Patent No.: US 6,554,718 B2
(45) Date of Patent: Apr. 29, 2003

(54) METHOD AND DEVICE FOR PLAYING GOLF

(76) Inventor: Daniel Back, Sandgatan 27, 745 35 Enkoping (SE)

( * ) Notice: Subject to any disclaimer, the term of this patent is extended or adjusted under 35 U.S.C. 154(b) by 0 days.

(21) Appl. No.: 09/877,162

(22) Filed: Jun. 8, 2001

(65) Prior Publication Data

US 2002/0028713 A1 Mar. 7, 2002

Related U.S. Application Data

(63) Continuation-in-part of application No. 09/656,008, filed on Sep. 6, 2000.

(51) Int. Cl.[7] ..... A63B 53/06; A63B 53/16; A63B 69/36; A63B 57/00

(52) U.S. Cl. ..... 473/276; 473/212; 473/215

(58) Field of Search ..... 473/215, 207, 473/277, 276, 59, 453, 458, 464, 450, 212, 214, 205, 227, 223, 219; D21/791

(56) References Cited

U.S. PATENT DOCUMENTS 3,820,781 A * 6/1974 Kane ..... 473/227
5,156,401 A * 10/1992 Hodgkiss ..... 473/227
6,386,988 B1 * 5/2002 Shearer et al. ..... 473/220

* cited by examiner

*Primary Examiner*—Paul T. Sewell
*Assistant Examiner*—Alvin A. Hunter, Jr.
(74) *Attorney, Agent, or Firm*—Rolf Fasth; Fasth Law Offices

(57) ABSTRACT

A device for the golf practice of short strokes and putting for a practicing person having a chest and upper arms. The device has an elongate object adapted to be fitted between the chest and the upper arms of the practicing person. The object has a central portion curved in a backward direction comprising opposite curved side portions that are curved in the same backward direction and extending to outer portions. The outer portions are curved in a forward direction opposite the backward direction. The device is held across the chest and outer portions are disposed behind the upper arms during the golf club stroke.

7 Claims, 5 Drawing Sheets

METHOD AND DEVICE FOR PLAYING GOLF

PRIOR APPLICATION

This is a continuation-in-part patent application of U.S. patent application Ser. No. 09/656,008, filed Sep. 6, 2000.

TECHNICAL FIELD

A method and golf aid device for aiding golf player to correctly swing a golf club.

BACKGROUND AND SUMMARY OF THE INVENTION

Many golf players are novice or have only intermediate skills. When playing golf, it is important to correctly swing the golf club to improve the chances of hitting the golf ball accurately. More particularly, many golf players experience problems when executing short strokes and putting due to lack of proper technique. The arms and wrists of the golf player have a tendency to control the movement of the golf club even though the golf player desires to perform the movement as a coordinated rotation of the chest and the arms. The erroneous manner of performing the swinging movement is most likely attributed to the fact that, in most cases, the movements of arms and hands are simple and easy to carry out compared to a coordinated rotation of the entire upper body of the golf player including the chest and arms. However, most modern scientific studies of the game of golf indicate that a considerably higher precision in the golf club swinging movement can be acquired by executing the movement as a rotation of the chest while the arms and hands are passive. The first time this correct movement is taught to a beginner of the game of golf, it is often experienced by the novice golf player as an unnatural movement. The novice golf player often thinks that more power are involved than are really needed for an effective golf club stroke. In earlier days, golf players were probably unknowingly assisted by the rigid clothes worn in the past. The clothes that were worn the golf was a new game restricted the movement of the arms more than today's casual clothes do to the detriment of the novice golf players.

As a result, many novice and intermediate golf players are struggling with the golf club swing and find it difficult to maintain the arms in the correct position relative to the chest during the swing. Many attempts have been made to properly instruct novice and intermediate level golf players to achieve a smooth and effective golf club swing. However, many golf players are still swinging the golf club incorrectly. There is a need for an inexpensive easy and convenient golf playing aid that forces the golf player to move the upper arms correctly relative to the chest of the golf player. There is also a need for an aid that may be quickly fitted on the player that does not interfere directly with the gripping and movement of the golf club and that is inexpensive to manufacture and takes the individual characteristics of the body structure and swing movement of each player into consideration.

The present invention is a device for the golf practice of short strokes and putting for a practicing person having a chest and upper arms. The device has an elongate object adapted to be fitted between the chest and the upper arms of the practicing person. The object has a central portion curved in a backward direction comprising opposite curved side portions that are curved in the same backward direction and extending to outer portions. The outer portions are curved in a forward direction opposite the backward direction. The device is held across the chest and outer portions are disposed behind the upper arms during the golf club stroke.

DETAILED DESCRIPTION

Figure 1:
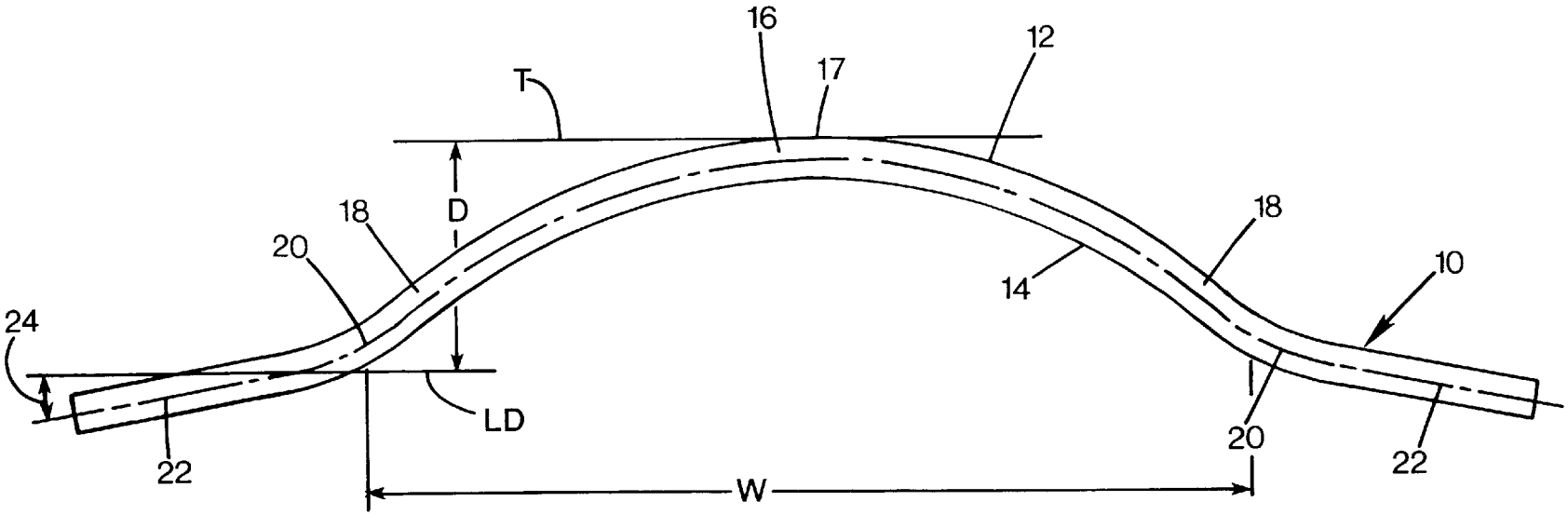
FIG. 1 is a top view of the golf device.
Figure 2:
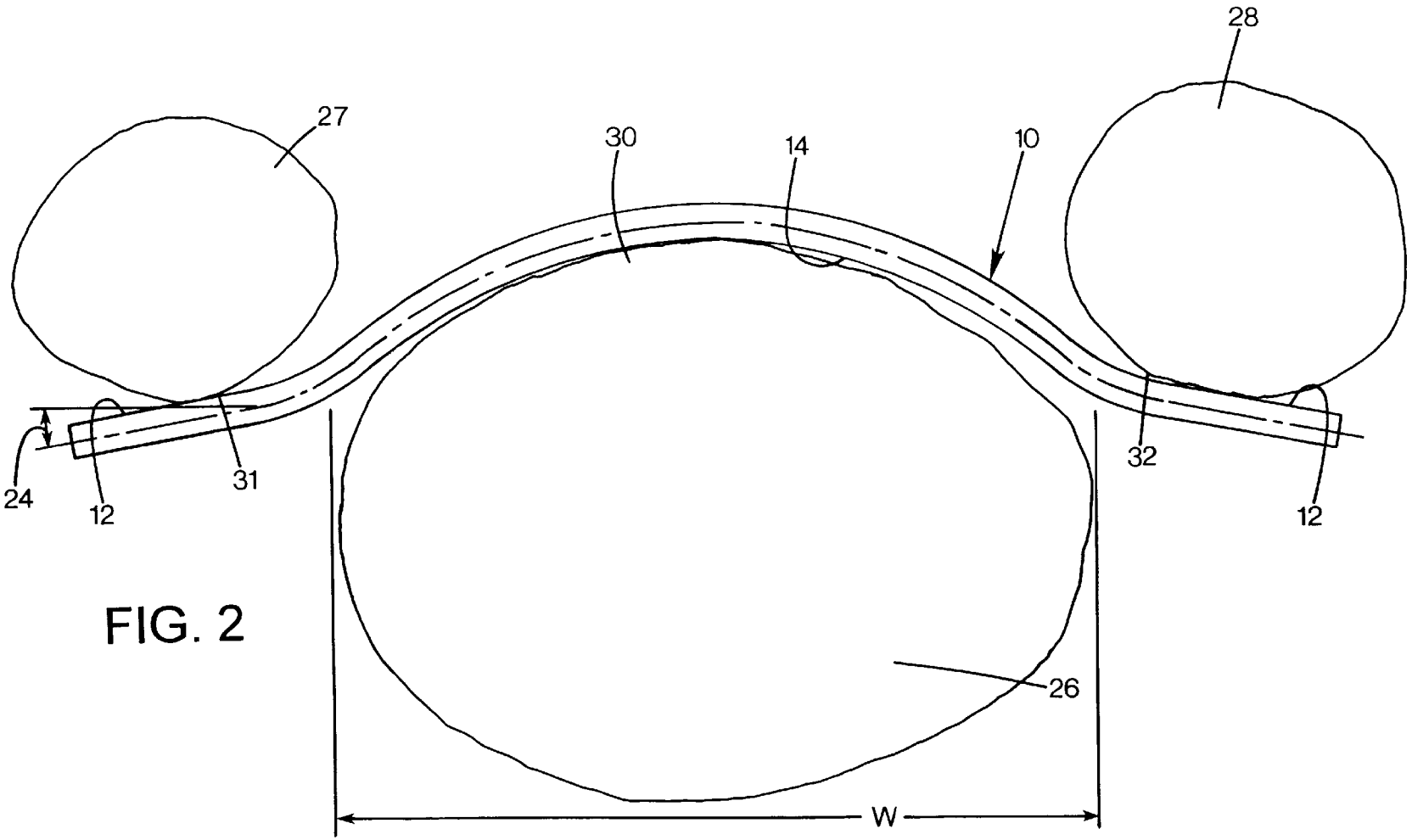
FIG. 2 is a top view of the golf device mounted on a golf player.
Figure 4:
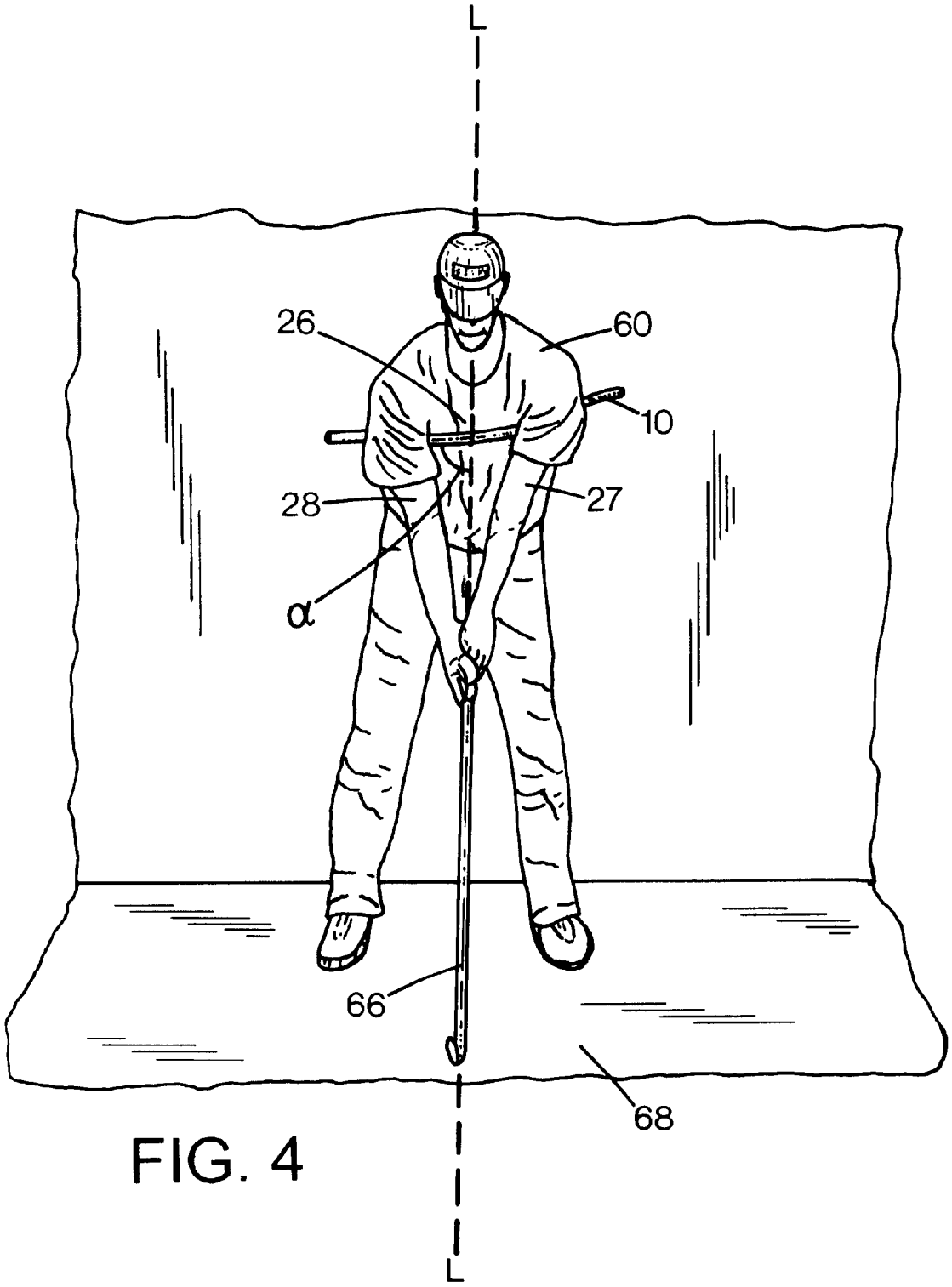
FIG. 4 is a front view of a golf player with the golf device of the present invention mounted thereon.
Figure 5:
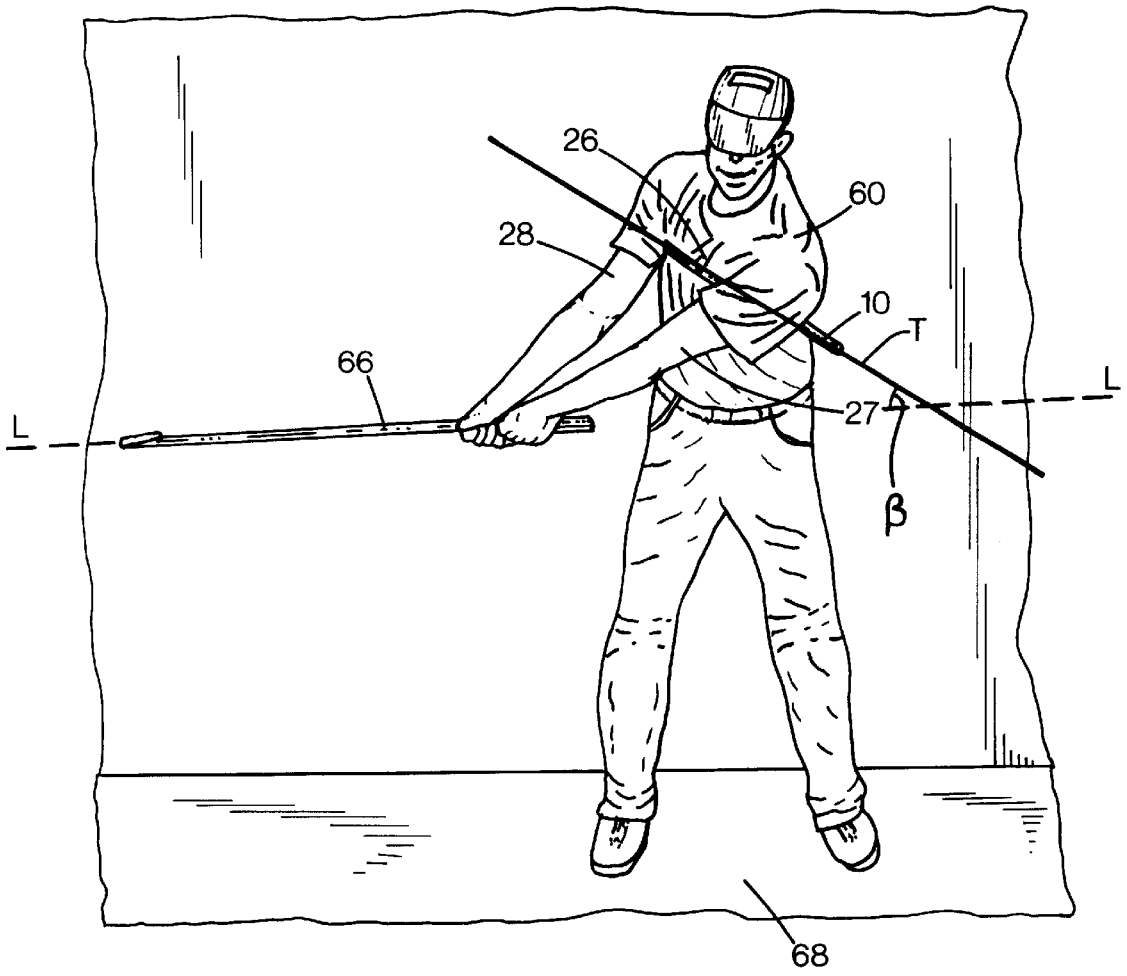
FIG. 5 is a front view of the golf player with a golf club in a backward swinging position.

With reference to FIGS. 1–2, the golf device 10 is, preferably, shaped like a bent rod with a convex external side 12 and a concave internal side 14. The device 10 has a curved central portion 16 that extends into opposite side portions 18. The side portions 18 extend into the outer end portions 22. A transition curvature 20 of the transition between the side portions 18 of the central portion 16 and the end portions 22 is opposite that of the curvature of the central portion 16. During use, a golf player may gently squeeze the device 10 between the golf player's chest 26 and upper arms 28 so that a front side 30 of the chest 26 is in contact with the concave internal side 14 of the central portion 16 of the device 10. The central portion 16 has an effective length W between the transition curvatures 20. The central portion 16 has an effective depth D that extends between a tangent T of a top point 17 of the central portion 16 and the transition curvatures 20. FIGS. 4 and 5 show the device 10 mounted on a golf player 60 who has a longitudinal direction L (see FIG. 5). A back side 32 of each upper arm 28 is, at the same time, in contact with the external side 12 of the outer portions 22. The external portions 22 may be moderately bent forwardly to form an acute angle 24 relative to a longitudinal direction LD of the device so that the device may come off the upper arms 32 with a certain degree of easiness when the pressure of the upper arms 32 against the outer portions 22 stop. This bend encourages, or even forces, the player 60 to maintain a constant pressure of the arms 28 against the device 10, during the stroke, so as not to drop the device 10 on the ground. The pressure automatically makes the arms 28 and chest 26 move together during the stroke of a golf club. Without a sufficient amount of pressure, the movement of the hands and lower arms may decrease the pressure on the device 10 too much so that the device may fall to the ground. The outer portions 22 may also be made with a pronounced forward curvature that curves around the upper arms 27, 28 when the device 10 is positioned on the golf player 60.

In the preferred embodiment of the device 10, the central portion 16 and the side portions 18 thereof show a continuous curvature with the same center and radius for the curvature. Other curvatures that follow the shape of the chest of the golf player are also conceivable, such as providing a more straight central portion 16 that is connected to the side portions 18 by pronounced curvatures of short radius. It is also possible to bend the outer portions 22. The bending of the portions 22 should, however, not be performed in excess since the arms 28 may be forced into an undesirable sideways locked position. An erroneous swinging position may then result if the device is not carefully adapted to the shape of each individual golf player.

Figure 3:
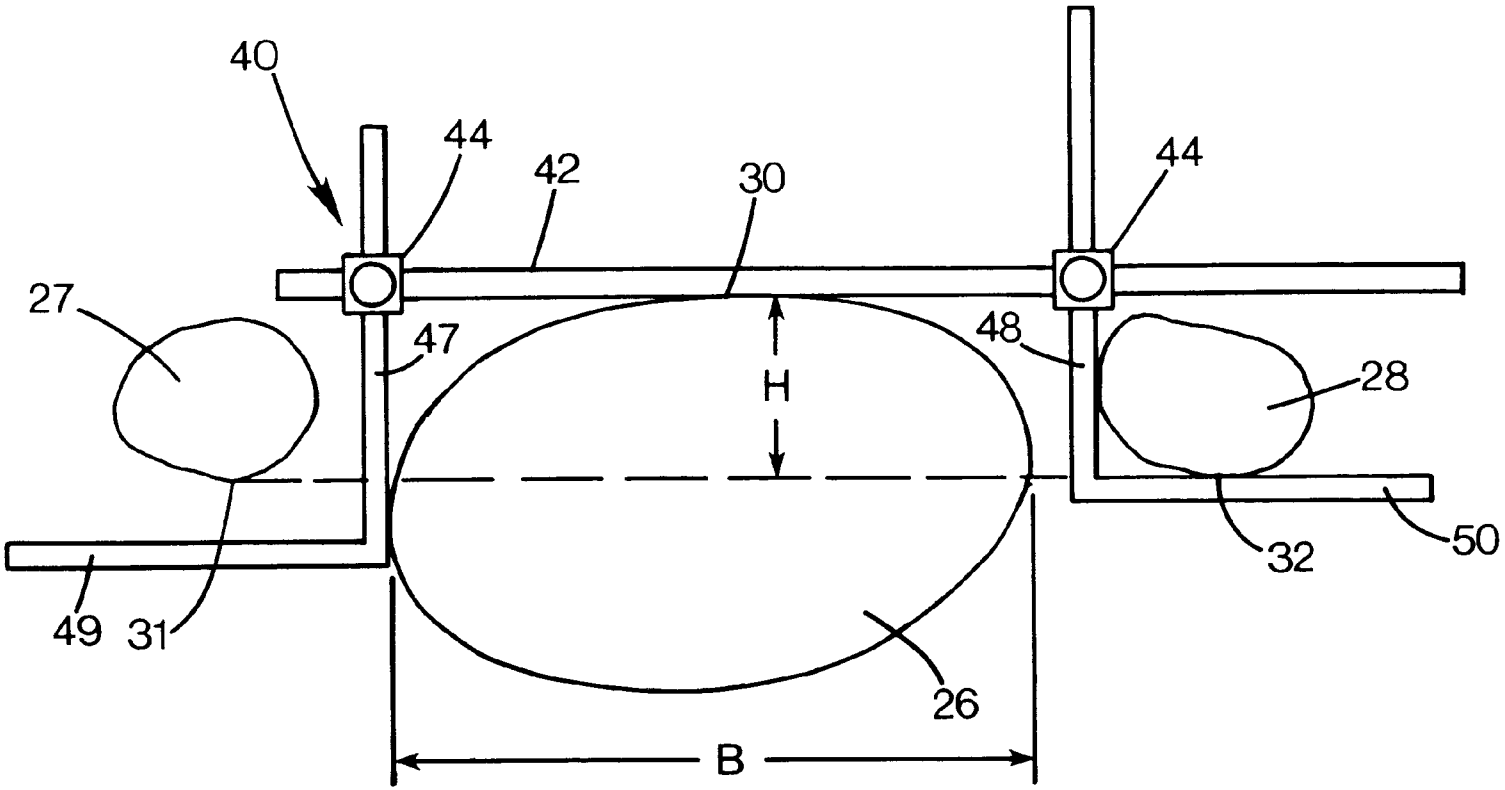
FIG. 3 is a top view of a measuring tool mounted on the golf player.

The device 10 may be supplied in a number of standard sizes to fit the size of different golfers. To optimize the use of the device 10, a gauge 40, as best shown in FIG. 3, may be applied on the player when the player has been positioned in a proper swinging position. The establishment of the proper swinging position may be performed under the supervision of a golf coach. Such a gauge can be a size adjustable element that when in a locked position, however, in itself is resistant to change of shape. Examples of such objects are rulers used for the drawing of curves. After testing, the measurements of the gauge 40 are compared to the existing shapes of the device 10 and the most similar existing shape is chosen. More particularly, the adjustable gauge 40 may be used to determine the important size parameters of the device 10. The width B of the chest 26 of the golf player may be measured by an effective length of a central bar 42 positioned between opposite locking devices 44. The depth/height H between the front 30 of the chest 26 and the back 32 of the upper arms 28 may be determined angular parts 47, 48 that are adjustably connected to the central bar 42 by the connecting locking devices 44. FIG. 3 shows the gauge 40 during the measuring step, before the gauge components have been placed in their final position. The devices 44 have holes defined therein and locking screws in engagement therewith to connect the devices 44 to the central bar 42 to adjust the effective length of the bar 42 disposed between the devices 44. Similarly, the effective length of angular parts 47, 48 relative to the central bar 42 may be adjusted depending upon where on the angular parts 47, 48 the devices 44 are connected. The size of the gauge 40 is so adjusted that the angular parts 47, 48 touch the side of the chest 26 at contact points 62, 64 and upper-arm extensions 49, 50 touch the back 31, 32 of the upper arms 27, 28, respectively. For example, in FIG. 3 the effective length of the angular part 47 should be made shorter so that the extension 49 properly bears upon the back 31 of the left upper arm 27. Similarly, the effective length of the central bar 42 should also be made shorter by shifting the right device 44 to the left on the central bar 42 until the angular part 48 bears against the contact point 64. When the gauge 40 has been properly adjusted to the particular size of the chest 26 and position of the upper arms 28, the golf player may either chose the standard size of the device 10 that is the closest to the size of the golf player or the golf player may have a customized device 10 made that perfectly fits the golf player.

In operation, the device 10 is placed between the chest 26 and the upper arms 27, 28 of the golf player 60. The device 10 is held in place by the golf player 60 by pressing the upper arms backwardly in the direction towards the chest 26 so that the outer portions 22 and the side portions 18 are captured therebetween. The central portion 16 should snugly fit over the chest 26 while the golf player 60 holds a golf club 66. FIG. 5 shows the golf club 66 in a raised position so that the club is substantially parallel to the ground 68 on which the golf player 60 stands. The golf player 60 is forced to hold the upper arms 27, 28 in the correct position relative to the front of the chest 26 to prevent the device 10 from falling on the ground. Also, the outer ends 22 prevents the upper arms 27, 28 from being too far back during the swing.

While the present invention has been described in accordance with preferred compositions and embodiments, it is to be understood that certain substitutions and alterations may be made thereto without departing from the spirit and scope of the following claims.

I claim:

1. A method of using a golf aid device for a golf player having a chest and arms holding a golf club, comprising:

providing a golf aid device having a curved central portion disposed between opposite outer ends, the curved central portion having a concave inside and a convex outside, the outer portions, the central portion being curved in a backward direction and the outer portions being curved in a forward direction opposite the backward direction;

placing the concave inside of the central portion on the chest and the opposite outer ends against a back side of the arms of the golf player;

pressing the back side of the arms against the outer ends so that the golf aid device is held to the golf player;

holding a golf club in a starting position so that a longitudinal direction (L) of the golf club forms a substantially square angle alpha with a tangent (T) of the golf aid device, the golf club being free from any attachment to the golf aid device; and moving the chest and arms together, with the device held between the arms and the chest, to swing the golf club in a swinging motion and move the golf club relative to the golf aid device until the longitudinal direction (L) of the golf club forms an angle beta with the tangent (T) of the golf aid device, the angle beta being an acute angle and different from the angle alpha.

2. The method according to claim 1 wherein the step of moving the arms and chest comprise lifting the golf club to a position that is substantially perpendicular to a longitudinal direction (L) of the golf player.

3. A method of hitting a golf ball with a golf club, comprising:

providing a golf aid device having a curved central portion disposed between opposite outer ends, the curved central portion having a concave inside and a convex outside, placing the concave inside of the central portion on a golf player's chest and the opposite outer ends against a back side of a pair of upper arms of the golf player;

holding a golf club so that a longitudinal direction (L) of the golf club forms a substantially square angle alpha with a tangent (T) of the golf aid device, the golf club being free from any attachment to the golf aid device;

swinging the golf club independently of the golf aid device, pressing the back side of the arms against the outer ends so that the golf aid device is held to the golf player; and moving the chest and arms together, with the device held between the arms and the chest, to swing the golf club in a swinging motion and move the golf club relative to the golf aid device so that the longitudinal direction (L) of the golf club forms an angle beta with the tangent (T) of the golf aid device, the angle beta being different from the angle alpha.

4. The method according to claim 3 wherein the method further comprises squeezing a device between the golf player's chest and the upper arms so that a front side of the chest is in contact with a concave internal side of a central portion of the device.

5. The method according to claim 3 wherein the method further comprises moving the backside of the upper arms into contact with an external side of the outer portions of the device.

6. The method according to claim 3 wherein the method further comprises maintaining a constant pressure of the upper arms against the device.

7. The method according to claim 3 wherein the method further comprises providing a sufficient amount of pressure on the device with the upper arms to prevent the device from falling down during the swinging of the golf club.

* * * * *